US006626693B2

(12) United States Patent
Sawada et al.

(10) Patent No.: US 6,626,693 B2
(45) Date of Patent: Sep. 30, 2003

(54) METAL TERMINAL AND METHOD OF FORMING METAL TERMINAL

(75) Inventors: Yoshitsugu Sawada, Shizuoka (JP); Takuya Hasegawa, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/982,911

(22) Filed: Oct. 22, 2001

(65) Prior Publication Data

US 2002/0048989 A1 Apr. 25, 2002

(30) Foreign Application Priority Data

Oct. 20, 2000 (JP) ..... 2000-320906

(51) Int. Cl.[7] ..... H01R 4/24

(52) U.S. Cl. ..... 439/404; 439/516; 439/885

(58) Field of Search ..... 439/404, 397, 439/516, 736, 883, 885

(56) References Cited

U.S. PATENT DOCUMENTS 5,000,699 A * 3/1991 Nadin ..... 439/511
5,219,294 A * 6/1993 Marsh et al. ..... 439/79
6,406,338 B1 * 6/2002 Endo et al. ..... 439/885

* cited by examiner

*Primary Examiner*—Khiem Nguyen
(74) *Attorney, Agent, or Firm*—Sughrue Mion, PLLC

(57) ABSTRACT

A JB (i.e., Junction Block) press-connecting terminal is formed by bending a metal sheet (20). The metal sheet (20) including a connection portion-corresponding portion (23) corresponding to a wire connection portion of the JB press-connecting terminal, a contact portion-corresponding portion (24) corresponding to an electrical contact portion of the JB press-connecting terminal, and a reinforcing interconnection portion (26). The reinforcing interconnection portion (26) is continuous at one end thereof with the connection portion-corresponding portion (23), and is continuous at the other end thereof with the contact portion-corresponding portion (24). The reinforcing interconnection portion (26) is removed when the metal sheet (20) is bent to be formed into a predetermined shape of the JB press-connecting terminal.

8 Claims, 9 Drawing Sheets

METAL TERMINAL AND METHOD OF FORMING METAL TERMINAL

BACKGROUND OF THE INVENTION

1. Field of the Invention

The present invention relates to a metal terminal including a wire connection portion to which an electric wire is connectable, and an electrical contact portion to which another metal terminal is connectable. More particularly, the present invention relates to a metal terminal in which the wire connection portion and the electrical contact portion are arranged to assume an L-shaped plan configuration. The present invention also relates to a method of forming the metal terminal.

The present application is based on Japanese Patent Application No. 2000-320906, which is incorporated herein by reference.

2. Description of the Related Art

A wire harness to be mounted on a vehicle, such as an automobile etc., is divided into a plurality of sub-harnesses corresponding respectively to functions of electronic equipments, and these sub-harnesses can be connected together. Therefore, the connection between wires of the sub-harnesses is complicated, and the efficiency of the assembling operation is lowered, and in the worst case, the stable quality is not obtained.

Therefore, in order to facilitate the connection between the electric wires, there has been proposed a plate connector comprising a plurality of plate-like insulating members stacked together, and press-connecting terminals attached to the plate-like insulating members. The plate-like insulating member is made of a synthetic resin. The plate-like insulating member includes a flat plate-like bottom wall, a plurality of partition walls extending upward from this bottom wall, and a plurality of communication holes.

The plurality of partition walls are arranged at equal intervals in parallel relation to one another. Any two adjacent ones of these partition walls jointly form a wire receiving groove therebetween for receiving an electric wire. The communication holes extend through the bottom wall. Each communication hole communicates with a tubular hole in an electrical contact portion of the press-connecting terminal mounted or placed on the bottom wall.

The press-connecting terminal is formed by bending a metal sheet. The press-connecting terminal includes a wire connection portion for connection to the electric wire, and the electrical contact portion of a tubular shape extending from the wire connection portion. The wire connection portion includes pairs of opposed press-connecting blades for being press-connected to the electric wire. A strip-like connection bar of an electrically-conductive nature is inserted in the electrical contact portion. In the press-connecting terminal, the wire connection portion and the electrical contact portion are arranged to assume an L-shaped plan configuration (that is, assume an L-shape when seen from above). The press-connecting terminal is placed on the bottom wall of the plate-like insulating member.

The press-connecting terminals are arranged on the plate-like insulating member in two directions, that is, in the longitudinal direction of the wire receiving grooves and in the direction of juxtaposition of the wire receiving grooves. Namely, the press-connecting terminals are arranged on the bottom wall of the plate-like insulating member in a two-dimensional matrix manner. A plurality of plate-like insulating members, each having the press-connecting terminals arranged in a two-dimensional matrix manner, are stacked one upon another, and the connection bar is inserted in the desired electrical contact portions superposed together. By doing so, the plate connector is obtained.

Thus, in the plate connector, the press-connecting terminals for being press-connected to the electric wires are mounted in desired positions on the bottom wall of each plate-like insulating member, and the connection bars are inserted in the desired electrical contact portions, so that the electric wires are interconnected according to a predetermined pattern.

In the press-connecting terminal used in the plate connector, the wire connection portion and the electrical contact portion are arranged to assume an L-shaped plan configuration. Therefore, in a metal sheet (blank) used for forming this press-connecting terminal, those portions thereof, corresponding respectively to the wire connection portion and the electrical contact portion, are also arranged to assume an L-shape.

Therefore, there is a possibility that during the time when the metal sheet is bent to form the press-connecting terminal, an interconnecting portion of this metal sheet, interconnecting the wire connection portion and the electrical contact portion, is deformed, so that the predetermined relative positional relation between the wire connection portion and the electrical contact portion after the forming operation can not be obtained. In the worst case, there is a possibility that the interconnecting portion is cut off, so that the wire connection portion and the electrical contact portion are separated from each other. Thus, there is a possibility that the yield rate after the forming operation is lowered by such dimensional irregularity.

SUMMARY OF THE INVENTION

It is therefore an object of the present invention to provide a metal terminal, as well as a method of forming the metal terminal, in which the yield rate after the forming operation is prevented from being lowered.

To achieve the above object, according to a first aspect of the present invention, there is provided a metal terminal which comprises:

a metal sheet comprising:

a first portion for forming a wire connection portion of the metal terminal to which an electric wire is connectable;

a second portion for forming an electrical contact portion of the metal terminal, in which an insertion member connectable to another terminal is insertable, and which extends from the wire connection portion;

a third portion for forming an interconnecting portion of the metal terminal interconnecting the wire connection portion and the electrical contact portion, wherein the wire connection portion and the electrical contact portion are disposed at a position assuming an L-shaped plan configuration in the metal terminal; and a reinforcing interconnection portion which is temporarily formed on the metal sheet so as to interconnect the first portion and the second portion, wherein when the metal sheet is bent to be formed into a predetermined shape, the reinforcing interconnection portion is removed.

In accordance with the first aspect, the interconnecting portion-corresponding portion (i.e., third portion) is prevented from being deformed before the metal terminal is formed, and the relative positional relation between the connection portion-corresponding portion (i.e., first portion) and the contact portion-corresponding portion (i.e., second portion) is prevented from being changed.

According to a second aspect of the present invention, it is preferable that the wire connection portion includes a mounting wall, on which the electric wire can be placed, and a side wall extending upward from the mounting wall, and the electrical contact portion includes a tubular portion for receiving the insertion member, wherein the first portion of the metal sheet includes a fourth portion corresponding to the mounting wall, and a fifth portion corresponding to the side wall, the second portion of the metal sheet includes a sixth portion corresponding to the tubular portion, and wherein the reinforcing interconnection portion of the metal sheet (1) has a strip-like shape, (2) is continuous at one end thereof with the fifth portion, and (3) is continuous at the other end thereof with the sixth portion.

In accordance with the second aspect, the interconnecting portion-corresponding portion (i.e., third portion) is further positively prevented from being deformed before the metal terminal is formed, and the relative positional relation between the connection portion-corresponding portion (i.e., first portion) and the contact portion-corresponding portion (i.e., second portion) is further positively prevented from being changed.

Alternatively, according to a third aspect of the present invention, it is preferable that the wire connection portion includes a mounting wall, on which the electric wire can be placed, and a side wall extending upward from the mounting wall, the interconnecting portion (1) has a strip-like shape, (2) is continuous at one end thereof with the side wall, and (3) is continuous at the other end thereof with the electrical contact portion, wherein the first portion of the metal sheet includes a fourth portion corresponding to the mounting wall, and a fifth portion corresponding to the side wall, and wherein the reinforcing interconnection portion of the metal sheet interconnects the fourth portion and the third portion.

In accordance with the third aspect, the interconnecting portion can more easily be deformed, and besides the relative positional relation between the wire connection portion and the electrical contact portion can be changed more easily. However, the reinforcing interconnection portion interconnects the mounting wall-corresponding portion (i.e., fourth portion) of the connection portion-corresponding portion (i.e., first portion) and the interconnecting portion-corresponding portion (i.e., third portion). Therefore, the interconnecting portion-corresponding portion (i.e., third portion) is positively prevented from being deformed before the metal terminal is formed, and the relative positional relation between the connection portion-corresponding portion (i.e., first portion) and the contact portion-corresponding portion (i.e., second portion) is positively prevented from being changed.

According to a fourth aspect of the present invention, there is provided a method of forming a metal terminal. The method comprises the steps of:

providing a metal sheet which comprises:

a first portion for forming a wire connection portion of the metal terminal to which an electric wire is connectable, a second portion for forming an electrical contact portion of the metal terminal, in which an insertion member connectable to another terminal is insertable, and which extends from the wire connection portion, a third portion for forming an interconnecting portion of the metal terminal interconnecting the wire connection portion and the electrical contact portion, wherein the wire connection portion and the electrical contact portion are disposed at a position assuming an L-shaped plan configuration in the metal terminal, and a reinforcing interconnection portion which is formed on the metal sheet so as to interconnect the first portion and the second portion;

bending the metal sheet to be formed into a predetermined shape; and removing the reinforcing interconnection portion.

In accordance with the fourth aspect, the advantageous effects similar to the first aspect are obtained.

According to a fifth aspect of the present invention, it is preferable that the removing step is performed after the second portion is bent to be formed into the electrical contact portion and before the first portion is bent to be formed into the wire connection portion.

In accordance with the fifth aspect, the relative positional relation between the electrical contact portion and the wire connection portion is positively prevented from being changed.

According to a sixth aspect of the present invention, it is preferable that the removing step is performed after the first portion and the second portion are bent to be formed respectively into the wire connection portion and the electrical contact portion.

In accordance with the sixth aspect, the relative positional relation between the electrical contact portion and the wire connection portion is more positively prevented from being changed.

BRIEF DESCRIPTION OF THE DRAWINGS

The above and other objects and advantages of the present invention will become more apparent by describing in detail preferred embodiments thereof with reference to the accompanying drawings, wherein.

DETAILED DESCRIPTION OF THE PREFERRED EMBODIMENTS

A JB (i.e., Junction Block) press-connecting terminal 50 (which is a first embodiment of a metal terminal of the present invention) will now be described with reference to FIGS. 1 to 10. The JB press-connecting terminals (the metal terminals of the first embodiment) 50 are attached to a press-connecting plate (plate-like insulating member) 60 shown in FIG. 3, and a plurality of press-connecting plates 60 are stacked together to form a stack plate connector 1 shown in FIG. 5. The JB press-connecting terminal is a so-called press-connecting terminal to which an electric wire is press-connected.

Figure 1:
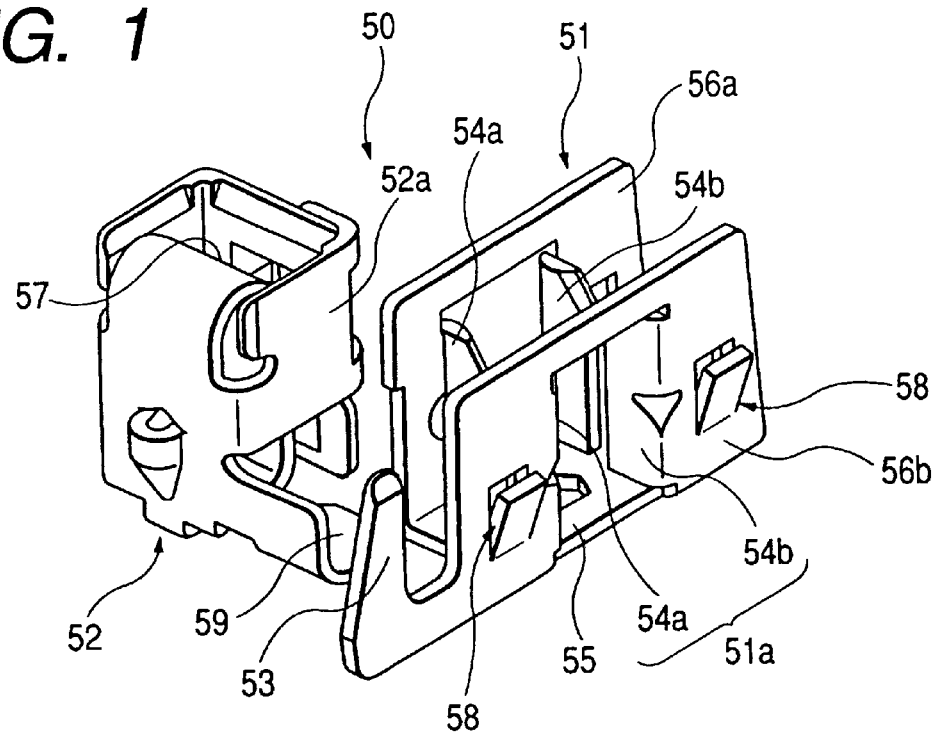
FIG. 1 is a perspective view showing a first embodiment of a JB (i.e., Junction Block) press-connecting terminal of the present invention.
Figure 6:
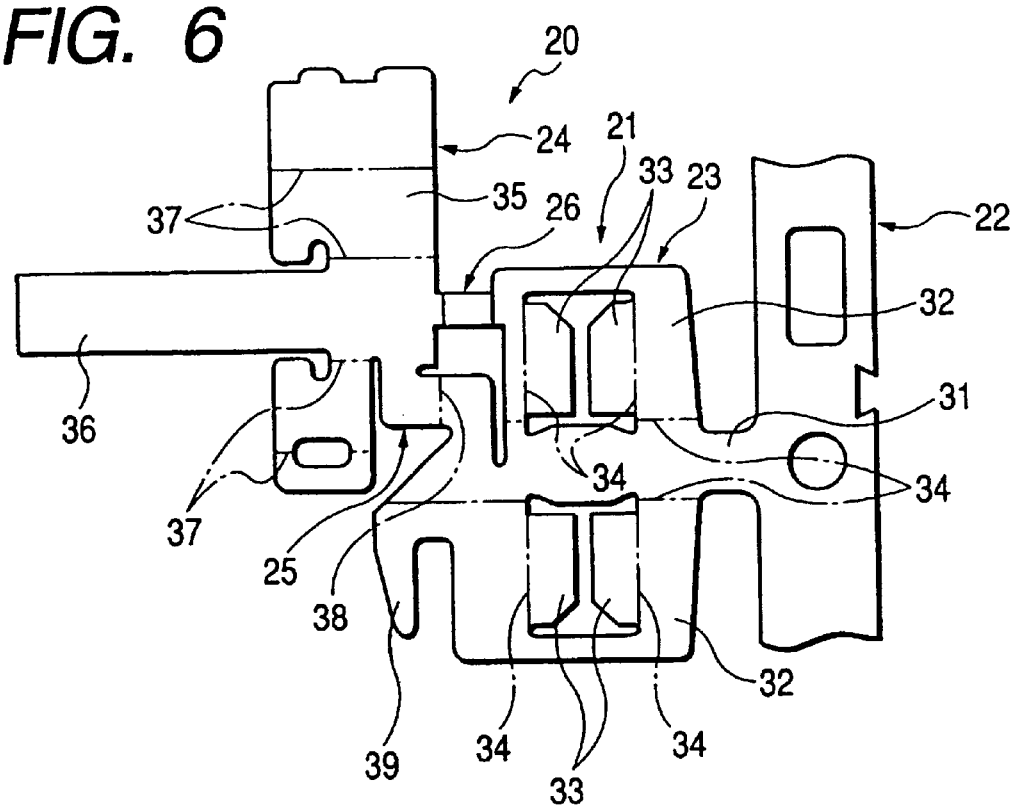
FIG. 6 is a plan view of a portion of a metal sheet for forming the JB press-connecting terminal of FIG. 1

The JB press-connecting terminal 50 is formed, for example, by bending an electrically-conductive metal sheet 20 (shown in FIG. 6). As shown in FIG. 1, the JB press-connecting terminal 50 includes a wire connection portion 51 for connection to the electric wire 4 (shown in FIG. 3), an electrical contact portion 52, a plurality of retaining piece portions 58, and an interconnecting portion 59.

The wire connection portion 51 includes a flat mounting wall 55, on which the electric wire 4 is placed, a pair of side walls 56*a* and 56*b*, a clamping piece portion 53, and a press-connecting portion 51*a*.

The mounting wall 55 has a strip-like shape. Each of the pair of side walls 56*a* and 56*b* has a strip-like shape. The pair of side walls 56*a* and 56*b* extend respectively from opposite side edges of the mounting wall 55 spaced from each other in a direction of the width thereof. The pair of side walls 56*a* and 56*b* extend upward from the mounting wall 55. The electric wire, press-connected to the press-connecting portion 51*a*, is disposed between the pair of side walls 56*a* and 56*b*.

The clamping piece portion 53 extends upward from the mounting wall 55. The clamping piece portion 53 extends from the widthwise side edge of the mounting wall 55. The clamping piece portion 53 is bent substantially in overlying relation to the mounting wall 55, and cooperates with this mounting wall 55 to hold the electric wire therebetween. Namely, the electric wire is press-fastened to the mounting wall 55 by the clamping piece portion 53.

The press-connecting portion 51*a* includes two pairs of opposed press-connecting blades 54*a* and 54*b*. The press-connecting blades 54*a* and 54*b* are disposed in upstanding relation to the mounting wall 55. Each pair of press-connecting blades 54*a*, 54*b* extend respectively from the inner surfaces of the opposed side walls 56*a* and 56*b* toward each other.

When the electric wire 4 is press-fitted into the gap between each pair of press-connecting blades 54*a*, 54*b*, these press-connecting blades cut a sheath of the electric wire 4 to contact a conductor thereof, and therefore are electrically connected to the electric wire 4. Namely, these press-connecting blades 54*a* and 54*b* are press-connected to the electric wire 4.

The electrical contact portion 52 is continuous with one widthwise side edge of the mounting wall 55. Namely, the electrical contact portion 52 is continuous with the wire connection portion 51. The electrical contact portion 52 and the wire connection portion 51 are disposed at a position assuming an L-shaped plan configuration (that is, an L-shape when seen from above) of the JB press-connecting terminal 50. The electrical contact portion 52 is disposed substantially perpendicularly to the wire connection portion 51 in offset relation to the longitudinal axis of the electric wire 4 placed on the mounting wall 55.

Figure 2:
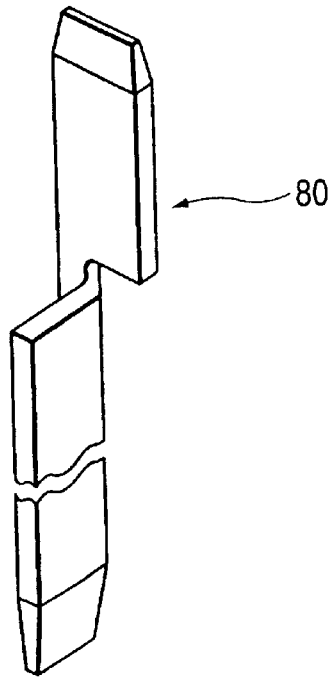
FIG. 2 is a perspective view of a connection bar for insertion in an electrical contact portion of the JB press-connecting terminal of the above embodiment.

The electrical contact portion 52 includes a tubular portion 52*a* of a square cross-section, and a connection spring piece portion 57. The tubular portion 52*a* is disposed in communication with a communication hole in the press-connecting plate 60. A connection bar (insertion member) 80, as shown in FIG. 2, is inserted in the tubular portion 52*a*. This connection bar 80 is made of electrically-conductive metal, and has a strip-like shape. The connection spring piece portion 57 is provided within the tubular portion 52*a*. The connection spring piece portion 57 presses the connection bar 80 toward the inner surface of the tubular portion 52*a*. The connection spring piece portion 57 electrically connects the electrical contact portion 52 to the connection bar 80.

When the press-connecting plates 60 are stacked together, the superposed JB press-connecting terminals 50 are electrically connected together by the connection bar 80 inserted in the tubular portions 52*a* of the electrical contact portions 52 thereof. Thus, the electrical contact portion 52 connects the JB press-connecting terminal to other JB press-connecting terminals (metal terminals).

The retaining piece portions 58 are formed by stamping predetermined portions of the side walls 56*a* and 56*b*. The retaining piece portions 58 are formed on the side walls 56*a* and 56*b*. Each retaining piece portion 58 extends at one end thereof from the side wall 56*a*, 56*b*, and the other end thereof is spaced from the side wall 56*a*, 56*b*. Particularly, the other end of each retaining piece portion 58 most projects outwardly from the outer surface of the side wall 56*a*, 56*b*.

As shown in FIG. 1, the retaining piece portion 58 is inclined in such a manner that the distance of this retaining piece portion 58 from the outer surface of the side wall 56*a*, 56*b* is increasing gradually in a direction from the one end thereof toward the other end thereof. When the JB press-connecting terminal 50 is attached to the press-connecting plate 60, the retaining piece portions 58 is retainingly engaged with an inner surface of a partition wall 63*b* (described later).

The interconnecting portion 59 interconnects the wire connection portion 51 and the electrical contact portion 52. The interconnecting portion 59 has a strip-like shape, and is continuous at one end thereof with the mounting wall 55. The interconnecting portion 59 is continuous at the other end thereof with the tubular portion 52*a* of the electrical contact portion 52. The interconnecting portion 59 interconnects the wire connection portion 51 and the electrical contact portion 52. The interconnection portion 59 has a uniform thickness over an entire length thereof, and is equal in thickness to the mounting wall 55.

The wire connection portion 51 of the JB press-connecting terminal 50 is received in a groove main portion

61*a* of a wire receiving groove 61 (described later) in the press-connecting plate 60, and the electrical contact portion 52 is received in a receiving portion 64 (described later) of the wire receiving groove 61. The JB press-connecting terminal 50 is press-fitted into the groove main portion 61*a* and the receiving portion 64, with the retaining piece portions 58 resiliently deformed in such a direction that the distance between the other ends of the opposed retaining piece portions 58 is reduced. When the JB press-connecting terminal 50 is thus press-fitted into the groove main portion 61*a* and the receiving portion 64, this terminal is received in (or held in or attached to) the press-connecting plate 60.

Figure 3:
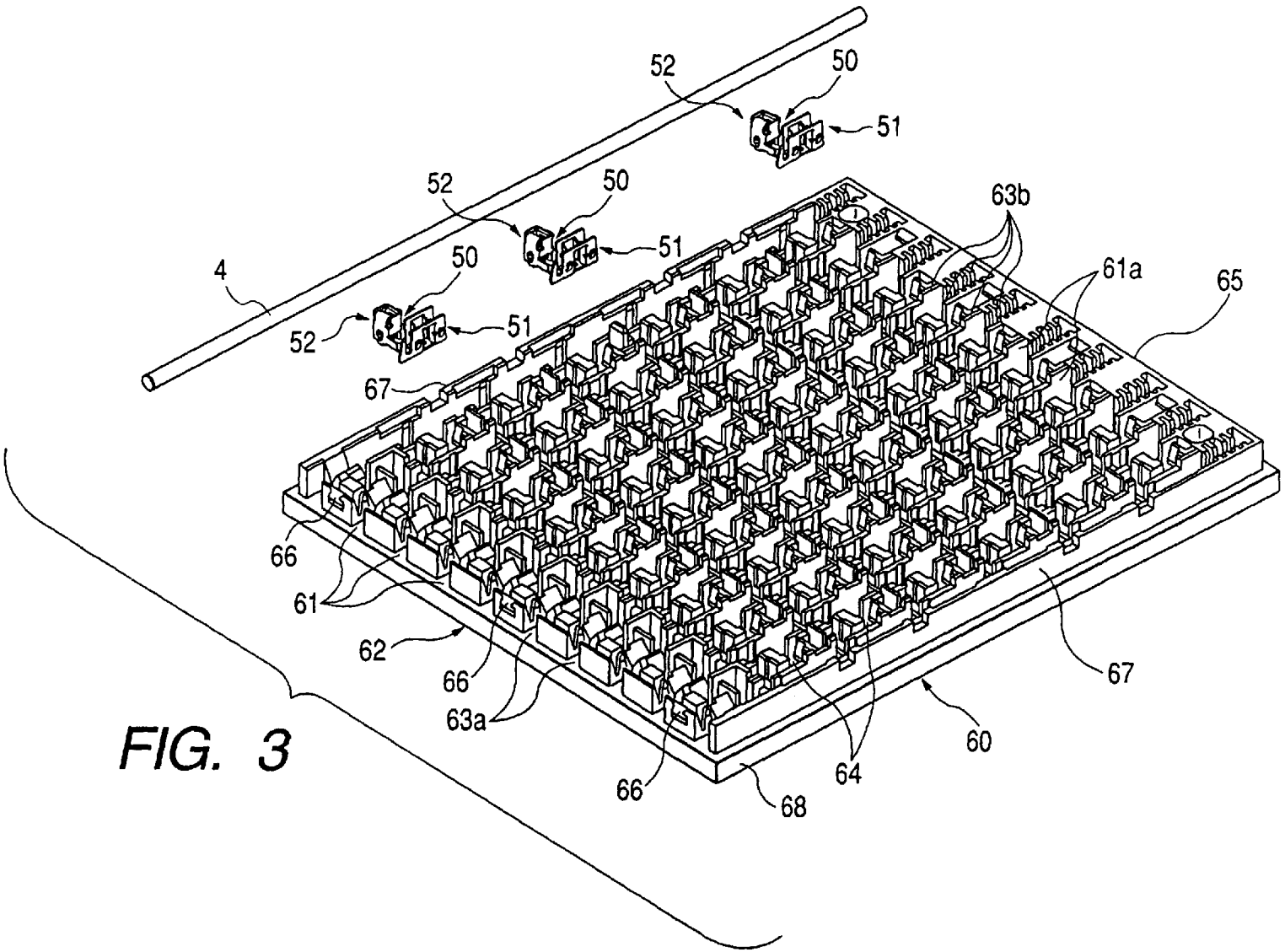
FIG. 3 is a perspective view showing a press-connecting plate to which the JB press-connecting terminals of the above embodiment are attached.
Figure 4:
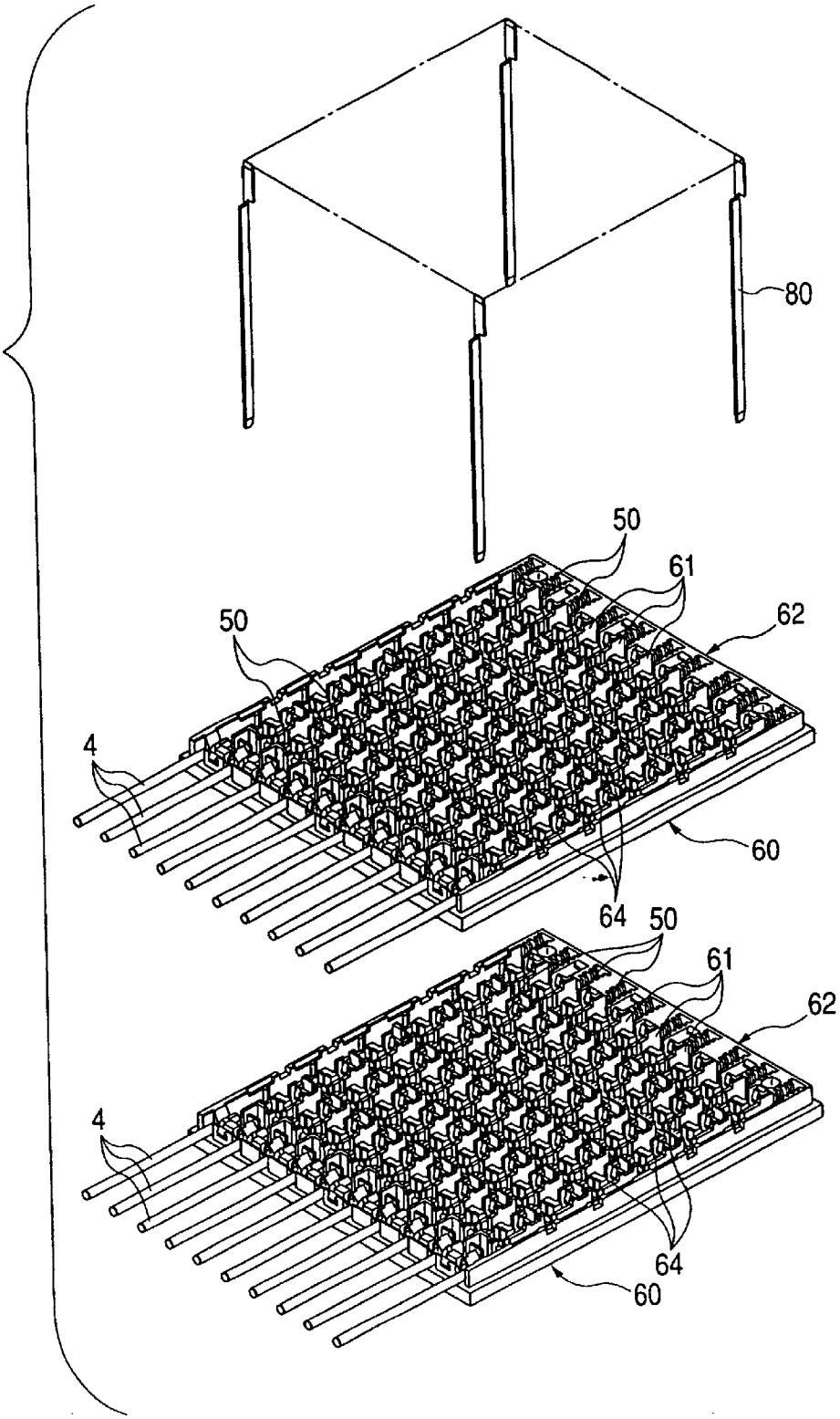
FIG. 4 is a perspective view showing the press-connecting plates of FIG. 3 superposed together in parallel, spaced relation to each other.
Figure 5:
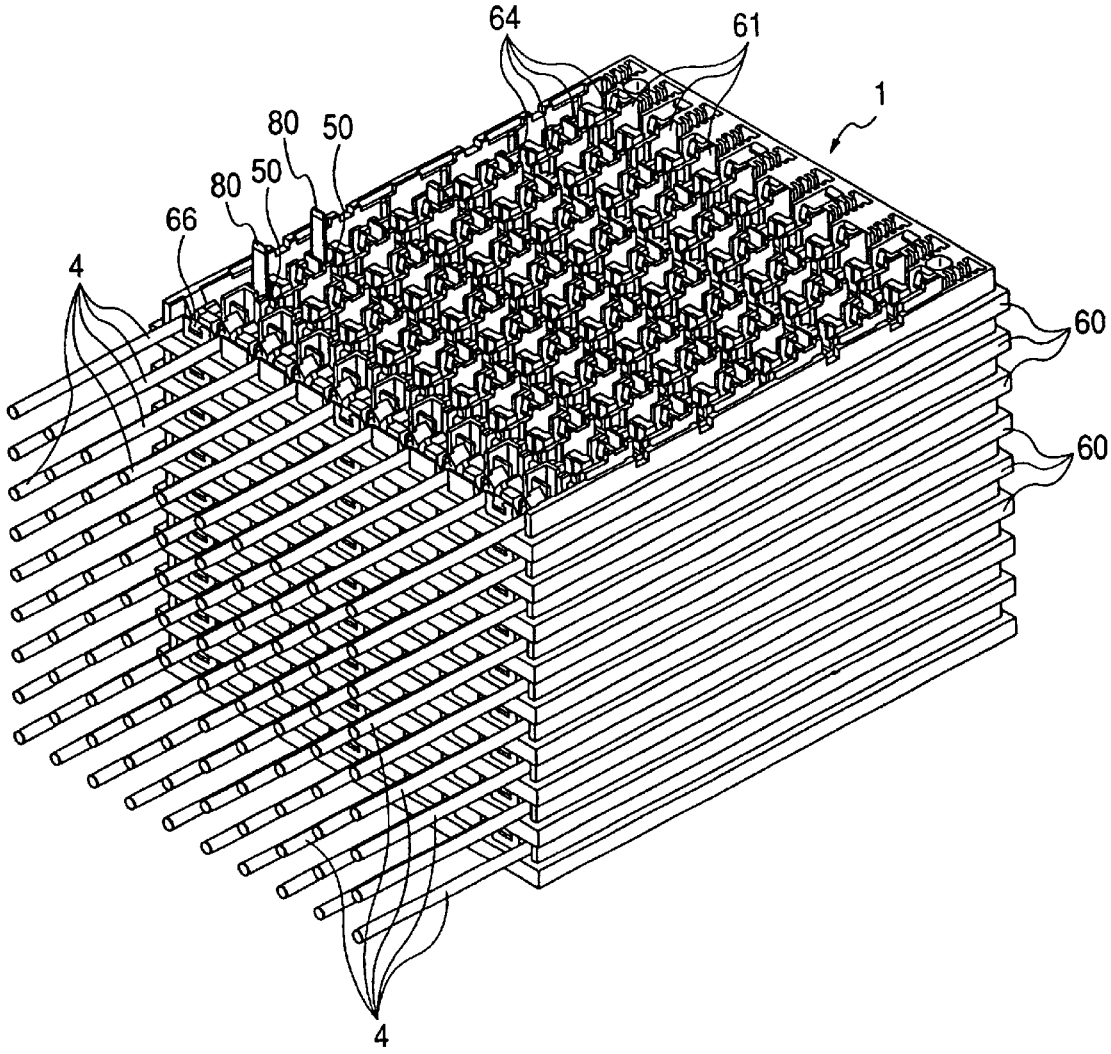
FIG. 5 is a perspective view showing a stack plate connector comprising the press-connecting plates of FIG. 3 fixed together.

The press-connecting plate 60 is made of an insulative synthetic resin or the like, and has a plate-like or flat plate-like shape. As shown in FIGS. 3 to 5, the press-connecting plate 60 includes a rectangular plate body 62, the plurality of wire receiving grooves 61, and the communication holes (not shown). The plate body 62 includes a substantially flat bottom wall 63*a,* a rear wall 65, a pair of side walls 67, the plurality of partition walls 63*b* extending upward from the bottom wall 63*a,* and a flange portion 68.

The rear wall 65 is continuous with one edge (disposed at the rear side in the drawings) of the bottom wall 63*a*. The rear wall 65 extends upward from the bottom wall 63*a*. The pair of side walls 67 are continuous with opposite side edges of the bottom wall 63*a,* respectively, and are continuous with the rear wall 65. The pair of side walls 67 extend upward from the bottom wall 63*a*. The pair of side walls 67 are parallel to each other.

The partition walls 63*b* are parallel to one another, and are spaced from one another. The partition walls 63*b* are parallel to the pair of side walls 67. The partition walls 63*b* extend in the longitudinal direction of the plate body 62.

The flange portion 68 projects outwardly from the peripheral edge of the bottom wall 63*a* of the plate body 62. The flange portion 68 projects outwardly beyond the outer surfaces of the rear wall 65 and the side walls 67. The flange portion 68 is formed on the bottom wall 63*a* over the entire periphery thereof. The flange portion 68 increases the rigidity of the bottom wall 63*a* and hence the rigidity of the plate body 62, thereby preventing the bottom wall 63*a* and hence the plate body 62 from being curved or warped.

The wire receiving groove 61 is formed by the two adjacent partition walls 63*b* and the bottom wall 63*a*. The wire receiving groove 61 includes the groove main portion 61*a,* and the receiving portions 64. The groove main portion 61*a* is formed by the inner surfaces of the two adjacent partition walls 63*b* and the surface of the bottom wall 63*a*. The groove main portion 61*a* extends along the side walls 67 and the partition walls 63*b*. The groove main portion 61*a* receives the wire connection portions 51 of the JB press-connecting terminals 50.

The receiving portions 64 are formed in recessed relation to the partition wall 63*b* so as to increase the distance between the two adjacent partition walls 63*b*. The receiving portions 64 are formed in the two adjacent partition walls 63*b* forming one wire receiving groove 61 therebetween. The receiving portions 64, formed in one of the two adjacent partition walls 63*b,* and the receiving portions 64, formed in the other partition wall 63*b,* are arranged alternately in the longitudinal direction of the groove main portion 61*a*.

Thus, the plurality of receiving portions 64 are arranged in a juxtaposed manner in the longitudinal direction of the groove main portion 61*a* of the wire receiving groove 61. The receiving portion 64 receives the electrical contact portion 52 of the JB press-connecting terminal 50 therein. The communication hole is formed in each of the receiving portions 64. The communication holes extend through the bottom wall 63*a* of the plate body 62.

The press-connecting plate 60 includes a plurality of retaining projections 66 and a plurality of retaining reception projections (not shown). The retaining projections 66 can be retainingly engaged with the corresponding retaining reception projections, respectively. When forming the stack plate connector 1, the retaining projections 66 are retainingly engaged with the corresponding retaining reception projections, respectively, thereby fixing the press-connecting plates 60 to one another.

The JB press-connecting terminals 50 are arranged on the bottom wall 63*a* of the press-connecting plate 60 in two directions, that is, in the longitudinal direction of the groove main portions 61*a* of the wire receiving grooves 61 and in the direction of juxtaposition of these wire receiving grooves 61. Namely, the JB press-connecting terminals 50 are arranged on the bottom wall 63*a* of the press-connecting plate 60 in a two-dimensional matrix manner.

For assembling the stack plate connector 1, first, the JB press-connecting terminals 50 are attached to each press-connecting plate 60. At this time, the JB press-connecting terminal 50 is moved toward the bottom wall 63*a,* and is attached to the plate body 62. The JB press-connecting terminal 50 is received in the wire receiving groove 61, with the retaining piece portions 58 retained by the inner surfaces of the partition walls 63*b,* so that the terminal 50 is fixed to the press-connecting plate 60.

Then, the electric wire 4 is press-connected to the JB press-connecting terminal 50, received in the groove main portion 61*a* and the receiving portion 64. At this time, the electric wire 4 is press-fitted in the gap between each pair of press-connecting blades 54*a,* 54*b* of the wire connection portion 51. In this condition, the press-connecting plates 60 are superposed together, with the plate bodies 62 disposed in parallel, spaced relation to each other, as shown in FIG. 4.

Then, any two adjacent press-connecting plates 60 are moved toward each other, so that the retaining projections 66 are retainingly engaged with the corresponding retaining reception projections, respectively, thereby fixing the press-connecting plates to each other. Each connection bar 80 is inserted and passed through the predetermined communication holes and tubular portions 52*a* of the electrical contact portions 52, thereby forming the stack plate connector 1 as shown in FIG. 5.

The positions of mounting of the JB press-connecting terminals 50 on the bottom wall 63*a* and the positions of insertion of the connection bars 80 are selected, and by doing so, the stack plate connector 1 can interconnect the electric wires 4, press-connected to the JB press-connecting terminals 50, according to a predetermined pattern. The stack plate connector 1, when mounted within an electric connection box having, for example, relays and fuses mounted thereon, connect the electric wires 4 to these relays and fuses according to a predetermined pattern.

The JB press-connecting terminal 50 is formed by bending the metal sheet 20 shown in FIG. 6. The metal sheet (blank) 20 is blanked from an electrically-conductive metal sheet. The metal sheet 20 has a substantially rectangular shape when seen from above.

As shown in FIG. 6, the metal sheet 20 includes terminal-corresponding portions 21, each to be formed into the JB press-connecting terminal 50 by bending, and a band-like (strip-like) interconnecting strip 22. The metal sheet 20 includes the plurality of terminal-corresponding portions 21 arranged in a juxtaposed manner. The terminal-corresponding portions 21 are interconnected by the interconnecting strip 22. When the JB press-connecting terminals 50, formed respectively by the terminal-corresponding portions 21, are mounted on the press-connecting plate 60, these JB press-connecting terminals 50 are cut off from the interconnecting strip 22.

As shown in FIG. 6, the terminal-corresponding portion 21 includes a connection portion-corresponding portion 23, corresponding to the wire connection portion 51, a contact portion-corresponding portion 24, corresponding to the electrical contact portion 52, and an interconnecting portion-corresponding portion 25, corresponding to the interconnecting portion 59, and a reinforcing interconnection portion 26.

The connection portion-corresponding portion 23 includes a mounting wall-corresponding portion 31, corresponding to the mounting wall 55, and a pair of side wall-corresponding portions 32 corresponding respectively to the sidewalls 56*a* and 56*b*. The mounting wall-corresponding portion 31 has a strip-like shape, and is continuous at one end thereof with the interconnecting strip 22. The longitudinal axis of the mounting wall-corresponding portion 31 intersects the longitudinal axis of the intersecting strip 22. In the illustrated embodiment, the longitudinal axis of the mounting wall-corresponding portion 31 perpendicularly intersects the longitudinal axis of the interconnecting strip 22.

The pair of side wall-corresponding portions 32 have a strip-like shape, and extend respectively from opposite side edges of the mounting wall-corresponding portion 31. Press-connecting blade-corresponding portions 33, corresponding respectively to the press-connecting blades 54*a* and 54*b*, are formed on each of the side wall-corresponding portions 32. A clamping piece-corresponding portion 39, corresponding to the clamping piece portion 53, is formed on one side wall-corresponding portion 32.

The connection portion-corresponding portion 23 is bent along bending lines 34 (indicated in dot-and-dash lines in FIG. 6) to be formed into the wire connection portion 51. The mounting wall-corresponding portion 31 corresponds to the mounting wall 55 of the wire connection portion 51 formed by bending the connection portion-corresponding portion along the bending lines 34. The side wall-corresponding portions 32 correspond respectively to the side walls 56*a* and 56*b*, and the press-connecting blade-corresponding portions 33 correspond to the press-connecting blades 54*a* and 54*b*.

The contact portion-corresponding portion 24 includes a tube-corresponding portion 35, corresponding to the tubular portion 52*a*, and a spring piece-corresponding portion 36 corresponding to the connection spring piece portion 57. The tube-corresponding portion 35 is continuous with the connection portion-corresponding portion 23 through the interconnecting portion-corresponding portion 25. The tube-corresponding portion 35 is continuous with that end of the mounting wall-corresponding portion 31 remote from the interconnecting strip 22. The tube-corresponding portion 35 has a strip-like shape, and extends longitudinally in parallel relation to the interconnecting strip 22. The spring piece-corresponding portion 36 has a strip-like shape, and extends from the tube-corresponding portion 35. The spring piece-corresponding portion 36 extends parallel to the longitudinal axis of the mounting wall-corresponding portion 31.

The contact portion-corresponding portion 24 is bent along bending lines 37 (indicated in dot-and-dash lines in FIG. 6), so that the tube-corresponding portion 35 is formed into the tubular portion 52*a*. The bending lines 37 extend parallel to the mounting wall-corresponding portion 31 and the spring piece-corresponding portion 36. The spring piece-corresponding portion 36 is bent, and is inserted into the tubular portion 52*a*. Thus, the electrical contact portion 52 is formed. The connection portion-corresponding portion 23 and the contact portion-corresponding portion 24 are disposed in a position assuming an L-shaped plan configuration (that is, an L-shape when seen from above) of the terminal-corresponding portion 21.

The interconnecting portion-corresponding portion 25 has a strip-like shape, and is continuous at one end thereof with the mounting wall-corresponding portion 31 of the connection portion-corresponding portion 23, and is continuous at the other end thereof with the tube-corresponding portion 35 of the contact portion-corresponding portion 24. The interconnecting portion-corresponding portion 25 is bent a long a bending line 38 (indicated by a dot-and-dash line in FIG. 6), so that the electrical contact portion 52 is disposed in upstanding relation to the mounting wall 55.

The reinforcing interconnection portion 26 has a strip-like shape, and is continuous at one end thereof with the other side wall-corresponding portion 32 of the connection portion-corresponding portion 23, and is continuous at the other end thereof with the tube-corresponding portion 35 of the contact portion-corresponding portion 24. The reinforcing interconnection portion 26 interconnects the other side wall-corresponding portion 32 of the connection portion-corresponding portion 23 and the tube-corresponding portion 35 of the contact portion-corresponding portion 24. The longitudinal axis of the reinforcing interconnection portion 26 is parallel to the longitudinal axis of the mounting wall-corresponding portion 31, and substantially coincides with the longitudinal axis of the spring piece-corresponding portion 36. In FIG. 6 and other, the reinforcing interconnection portion 26 is indicated by hatching.

Figure 7:
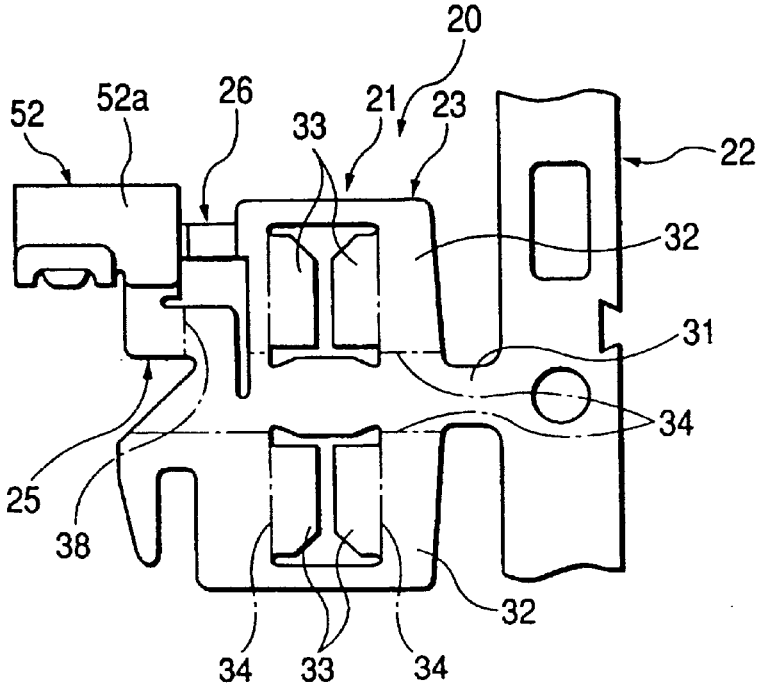
FIG. 7 is a plan view of the metal sheet of FIG. 6, showing a condition in which an electrical contact portion is formed.

For forming the JB press-connecting terminal 50, the tube-corresponding portion 35 of the terminal-corresponding portion 21 of the metal sheet 20 of the above construction is first bent along the bending lines 37 to form the tubular portion 52*a*, and the spring piece-corresponding portion 36 is bent, and is inserted into the tubular portion 52*a*. The electrical contact portion 52 is formed as shown in FIG. 7.

Figure 8:
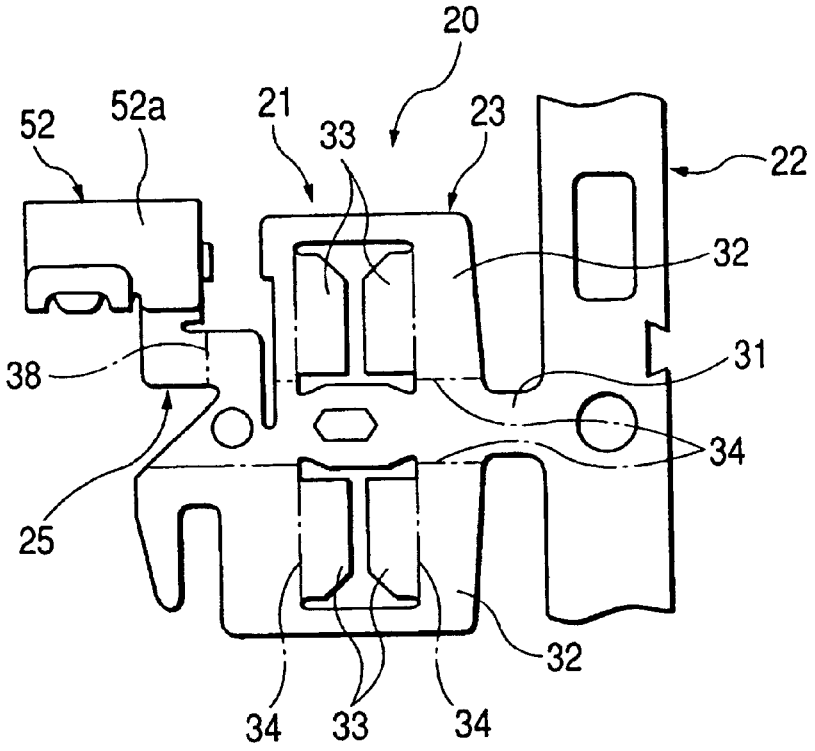
FIG. 8 is a plan view of the metal sheet of FIG. 7, showing a condition in which a reinforcing interconnection portion is removed therefrom.
Figure 9:
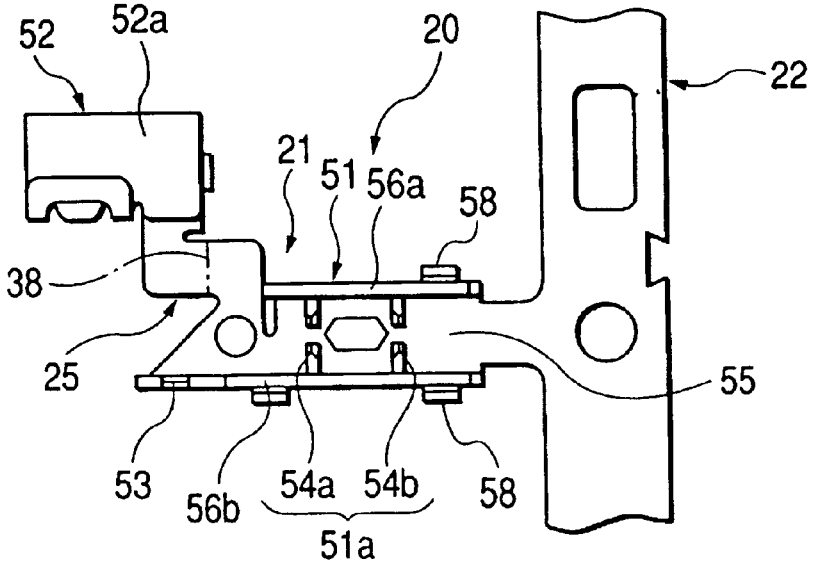
FIG. 9 is a plan view of the metal sheet of FIG. 8, showing a condition in which a wire connection portion is formed.
Figure 10:
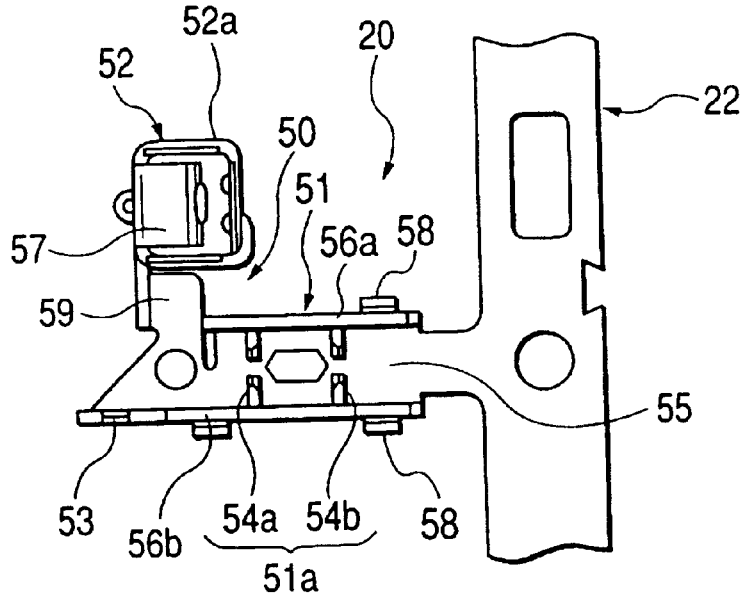
FIG. 10 is a plan view showing a condition in which the JB press-connecting terminal is formed from the metal sheet of FIG. 9.

Then, a stamping operation or the like is applied to the terminal-corresponding portion 21, thereby removing the reinforcing interconnection portion 26 from the connection portion-corresponding portion 23 and the electrical contact portion 52, as shown in FIG. 8. The connection portion-corresponding portion 23 is bent along the bending lines 34 to form the wire connection portion 51 as shown in FIG. 9. Then, the interconnecting portion-corresponding portion 25 is bent along the bending line 38, thereby bringing the electrical contact portion 52 into an upstanding condition relative to the wire connection portion 51, as shown in FIG. 10. Thus, the JB press-connecting terminal 50 is formed.

In this embodiment, the reinforcing interconnection portion 26 of the metal sheet 20, which is to be removed when the JB press-connecting terminal 50 is formed, interconnects the side wall-corresponding portion 32 of the connection portion-corresponding portion 23 and the tube-corresponding portion 35 of the contact portion-corresponding portion 24. Therefore, the interconnecting portion-corresponding portion 25, corresponding to the interconnecting portion 59, is prevented from being deformed during the forming operation and others, and the relative positional relation between the connection portion-corresponding portion 23 and the contact portion-corresponding portion 24 is prevented from being changed.

Therefore, the relative positional relation between the wire connection portion 51 and the electrical contact portion 52 after the formation of the terminal is prevented from being changed, and besides the interconnecting portion 59 is prevented from being broken, thereby preventing the separation of the wire connection portion 51 and the electrical contact portion 52 from each other. Therefore, the yield rate after the forming operation is prevented from being lowered.

After the electrical contact portion 52 is formed, the reinforcing interconnection portion 26 is removed, and therefore the relative positional relation between the wire connection portion 51 and the electrical contact portion 52 is positively prevented from being changed during the formation of the electrical contact portion 52. Therefore, the relative positional relation between the wire connection portion 51 and the electrical contact portion 52 is prevented from being changed after the formation of the JB press-connecting terminal 50. Therefore, the yield rate after the forming operation is more positively prevented from being lowered.

Next, a JB (Junction Block) press-connecting terminal 50 (which is a second embodiment of a metal terminal of the present invention) will be described with reference to FIGS. 11 to 14. Those portions of this embodiment, identical in construction to their respective corresponding portions of the first embodiment, will be designated by identical reference numerals, respectively, and explanation thereof will be omitted.

Figure 11:
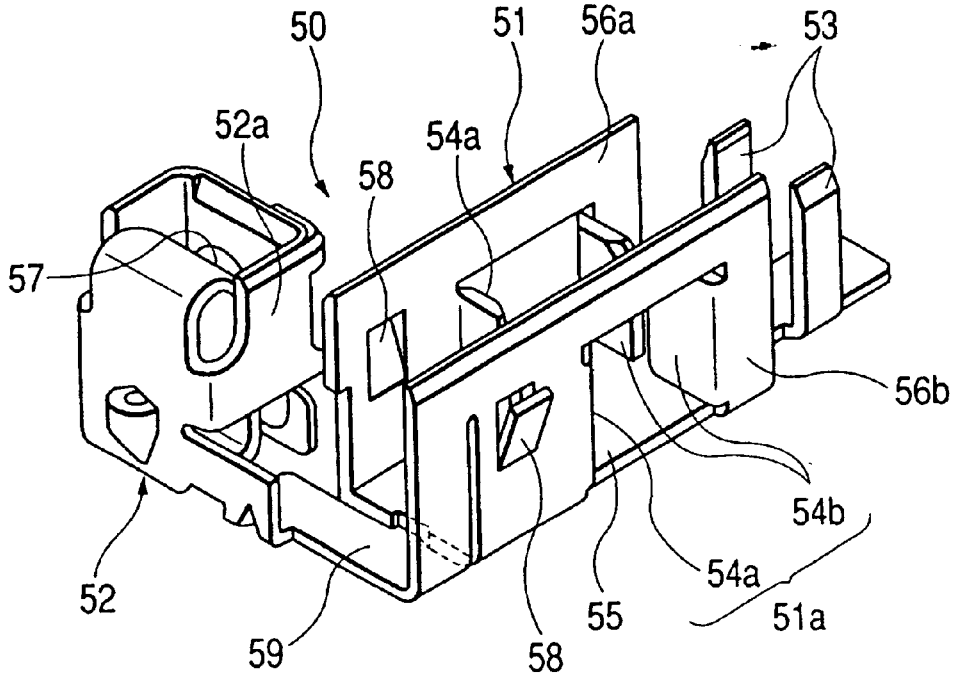
FIG. 11 is a perspective view showing a second embodiment of a JB press-connecting terminal of the present invention.
Figure 14:
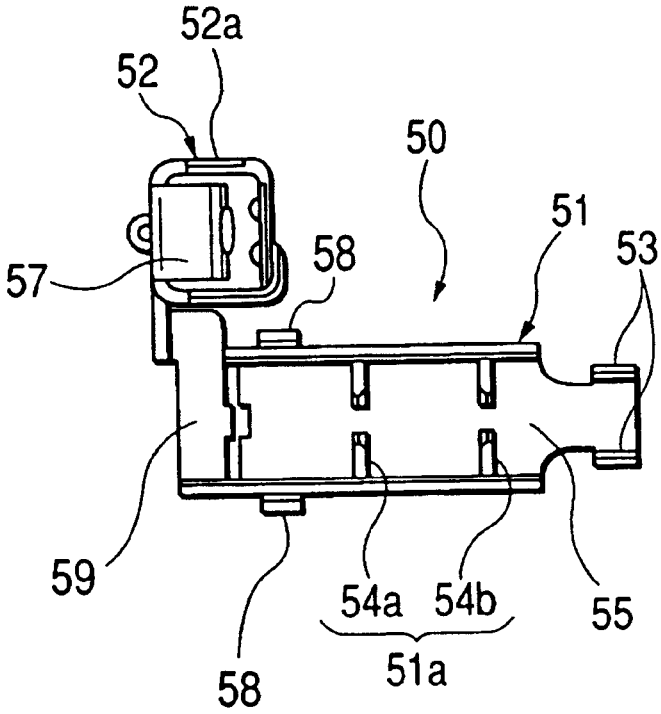
FIG. 14 is a plan view showing a condition in which the JB press-connecting terminal of FIG. 13 is cutoff from an interconnecting strip, and a reinforcing interconnection portion is removed.

As shown in FIGS. 11 and 14, an interconnecting portion 59 of the JB press-connecting portion 50 of this embodiment is continuous at one end thereof with a side wall 56*b* remote from an electrical contact portion 52, and is continuous at the other end thereof with the electrical contact portion 52.

Figure 12:
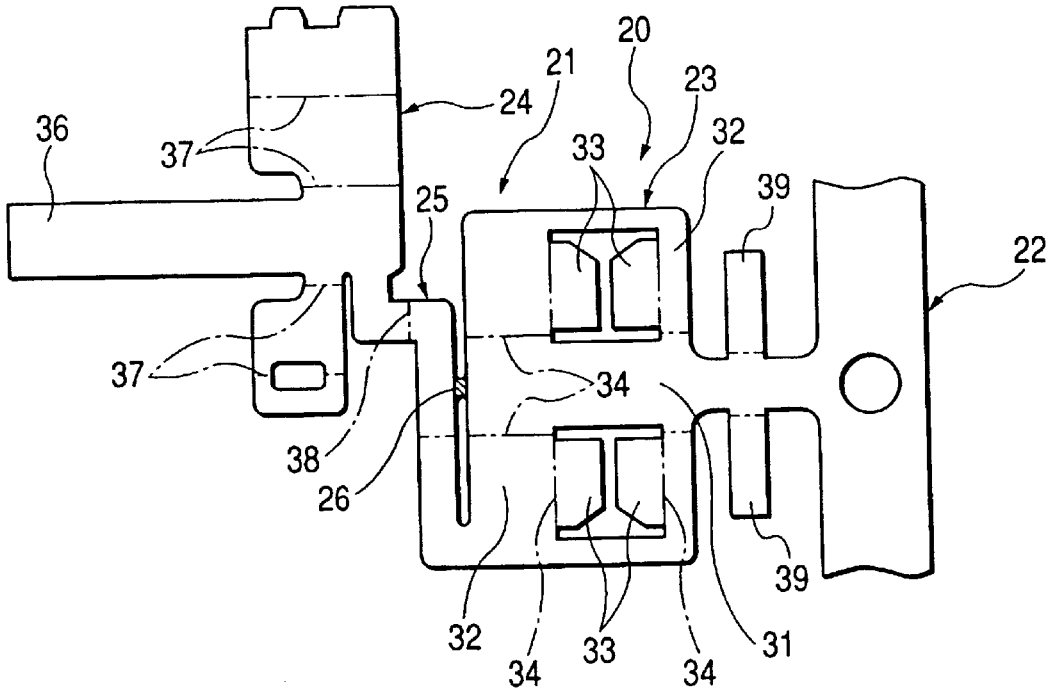
FIG. 12 is a plan view of a portion of a metal sheet for forming the JB press-connecting terminal of FIG. 11.
Figure 13:
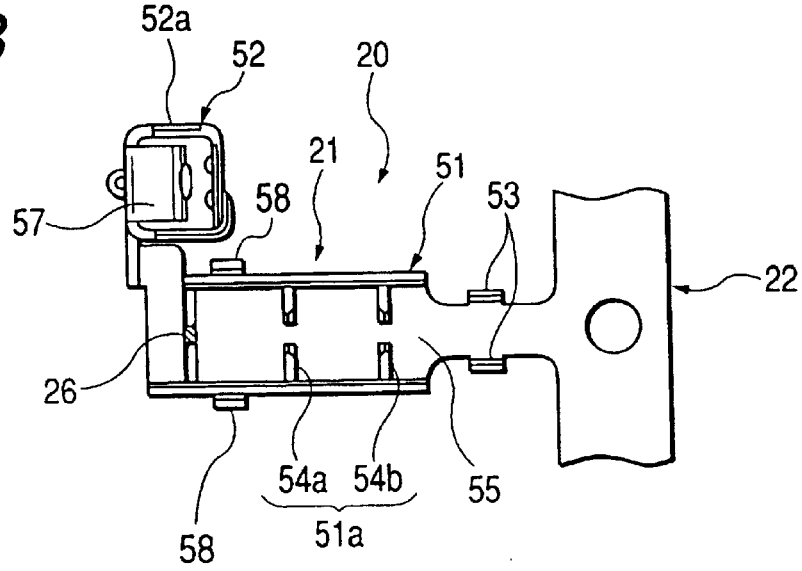
FIG. 13 is a plan view showing a condition in which the JB press-connecting terminal is formed from the metal sheet of FIG. 12.

With respect to a terminal-corresponding portion 21 of a metal sheet 20, a reinforcing interconnection portion 26 interconnects a mounting wall-corresponding portion 31 and an interconnecting portion-corresponding portion 25, as shown in FIG. 12. In FIGS. 12 and 13, the reinforcing interconnection portion 26 is indicated by hatching.

In this embodiment, the terminal-corresponding portion 21 is bent along bending lines 34, 37 and 38 to form the JB press-connecting terminal 50 as shown in FIG. 13. The JB press-connecting terminal 50, when in a condition of FIG. 13, is connected to an interconnecting strip 22. Immediately before the press-connecting terminal 50 is attached to the press-connecting plate 60, it is cut off from the interconnecting strip 22, and the reinforcing interconnection portion 26 is removed from a mounting wall 55 and the interconnecting portion 59.

In this embodiment, the interconnecting portion 59 has a strip-like shape, and interconnects the side wall 56*b* of a wire connection portion 51 and the electrical contact portion 52. Therefore, the interconnecting portion 59 can be deformed more easily, and besides the relative positional relation between the wire connection portion 51 and the electrical contact portion 52 can be changed more easily.

However, the reinforcing interconnection portion 26 interconnects the mounting wall-corresponding portion 31 and the interconnection portion-corresponding portion 25. Therefore, the interconnecting portion-corresponding portion 25, corresponding to the interconnecting portion 59, is prevented from being deformed during the forming operation and others, and the relative positional relation between a connection portion-corresponding portion 23 and a contact portion-corresponding portion 24 is prevented from being changed.

Therefore, the relative positional relation between the wire connection portion 51 and the electrical contact portion 52 after the formation of the terminal is prevented from being changed, and besides the interconnecting portion 59 is prevented from being broken, thereby preventing the separation of the wire connection portion 51 and the electrical contact portion 52 from each other. Therefore, the yield rate after the forming operation is prevented from being lowered.

After the wire connection portion 51 and the electrical contact portion 52 are formed, the reinforcing interconnection portion 26 is removed, and therefore the relative positional relation between the connection portion-corresponding portion 23 and the contact portion-corresponding portion 24 is positively prevented from being changed during the formation of the JB press-connecting terminal 50. Therefore, the yield rate after the forming operation is more positively prevented from being lowered.

As described above, in the embodiments, the reinforcing interconnection portion of the metal sheet, which is to be removed when the metal terminal is formed, interconnects the connection portion-corresponding portion, corresponding to the wire connection portion, and the contact portion-corresponding portion corresponding to the electrical contact portion. Therefore, the interconnecting portion-corresponding portion, corresponding to the interconnecting portion, is prevented from being deformed before the metal terminal is formed, and the relative positional relation between the connection portion-corresponding portion and the contact portion-corresponding portion is prevented from being changed.

Therefore, the relative positional relation between the wire connection portion and the electrical contact portion after the formation of the terminal is prevented from being changed, and the wire connection portion and the electrical contact portion are prevented from being separated from each other. Therefore, the yield rate after the forming operation is positively prevented from being lowered.

In the embodiment, the reinforcing interconnection portion interconnects the side wall-corresponding portion of the connection portion-corresponding portion and the tube-corresponding portion of the contact portion-corresponding portion. Therefore, the interconnecting portion-corresponding portion is positively prevented from being deformed before the metal terminal is formed, and the relative positional relation between the connection portion-corresponding portion and the contact portion-corresponding portion is positively prevented from being changed.

Therefore, the relative positional relation between the wire connection portion and the electrical contact portion after the formation of the terminal is prevented from being changed, and the wire connection portion and the electrical contact portion are prevented from being separated from each other. Therefore, the yield rate after the forming operation is more positively prevented from being lowered.

In the embodiment, the interconnecting portion has a strip-like shape, and interconnects the side wall of the wire connection portion and the electrical contact portion. Therefore, the interconnecting portion can be deformed more easily, and besides the relative positional relation between the wire connection portion and the electrical contact portion can be changed more easily.

However, the reinforcing interconnection portion interconnects the mounting wall-corresponding portion of the connection portion-corresponding portion and the interconnection portion-corresponding portion. Therefore, the relative positional relation between the wire connection portion and the electrical contact portion is positively prevented from being changed after the formation of the metal terminal, and the wire connection portion and the electrical contact portion are prevented from being separated from each other. Therefore, the yield rate after the forming operation is more positively prevented from being lowered.

In the embodiment, the reinforcing interconnection portion is removed after the electrical contact portion is formed, and therefore the relative positional relation between the electrical contact portion and the wire connection portion is positively prevented from being changed. Therefore, the relative positional relation between the wire connection portion and the electrical contact portion is prevented from being changed after the formation of the metal terminal. Therefore, the yield rate after the forming operation is more positively prevented from being lowered.

In the embodiment, the reinforcing interconnection portion is removed after the electrical contact portion and the wire connection portion are both formed, and therefore the relative positional relation between the electrical contact portion and the wire connection portion is more positively prevented from being changed. Therefore, the relative positional relation between the wire connection portion and the electrical contact portion is prevented from being changed after the formation of the metal terminal. Therefore, the yield rate after the forming operation is more positively prevented from being lowered.

It is contemplated that numerous modifications may be made to the metal terminal, and the method of forming a metal terminal, of the present invention without departing from the spirit and scope of the invention as defined in the following claims.

What is claimed is:

1. A metal terminal, comprising:

a metal sheet comprising:

a first portion for forming a wire connection portion of the metal terminal to which an electric wire is connectable;

a second portion for forming an electrical contact portion of the metal terminal, in which an insertion member connectable to another terminal is insertable, and which extends from the wire connection portion;

a third portion for forming an interconnecting portion of the metal terminal interconnecting the wire connection portion and the electrical contact portion, wherein the wire connection portion and the electrical contact portion are disposed at a position assuming an L-shaped plan configuration in the metal terminal; and a reinforcing interconnection portion which is temporarily formed on the metal sheet so as to interconnect the first portion and the second portion, wherein when the reinforcing portion is removed when the metal sheet is bent into a predetermined shape.

2. The metal terminal of claim 1, wherein the wire connection portion includes a mounting wall, on which the electric wire can be placed, and a side wall extending upward from the mounting wall, and the electrical contact portion includes a tubular portion for receiving the insertion member, wherein the first portion of the metal sheet includes a fourth portion corresponding to the mounting wall, and a fifth portion corresponding to the side wall, the second portion of the metal sheet includes a sixth portion corresponding to the tubular portion, and wherein the reinforcing interconnection portion of the metal sheet (1) has a strip-like shape, (2) is continuous at one end thereof with the fifth portion, and (3) is continuous at the other end thereof with the sixth portion.

3. The metal terminal of claim 1, wherein the wire connection portion includes a mounting wall, on which the electric wire can be placed, and a side wall extending upward from the mounting wall, the interconnecting portion (1) has a strip-like shape, (2) is continuous at one end thereof with the side wall, and (3) is continuous at the other end thereof with the electrical contact portion, wherein the first portion of the metal sheet includes a fourth portion corresponding to the mounting wall, and a fifth portion corresponding to the side wall, and wherein the reinforcing interconnection portion of the metal sheet interconnects the fourth portion and the third portion.

4. The metal terminal of claim 2, wherein the reinforcing interconnection portion is removed after the second portion is bent to be formed into the electrical contact portion and before the first portion is bent to be formed into the wire connection portion.

5. The metal terminal of claim 3, wherein the reinforcing interconnection portion is removed after the first portion and the second portion are bent to be formed respectively into the wire connection portion and the electrical contact portion.

6. A method of forming a metal terminal, comprising the steps of:

providing a metal sheet which comprises:

a first portion for forming a wire connection portion of the metal terminal to which an electric wire is connectable, a second portion for forming an electrical contact portion of the metal terminal, in which an insertion member connectable to another terminal is insertable, and which extends from the wire connection portion, a third portion for forming an interconnecting portion of the metal terminal interconnecting the wire connection portion and the electrical contact portion, wherein the wire connection portion and the electrical contact portion are disposed at a position assuming an L-shaped plan configuration in the metal terminal, and a reinforcing interconnection portion which is formed on the metal sheet so as to interconnect the first portion and the second portion;

bending the metal sheet to be formed into a predetermined shape; and removing the reinforcing interconnection portion.

7. The method of claim 6, wherein the wire connection portion includes a mounting wall, on which the electric wire can be placed, and a side wall extending upward from the mounting wall, and the electrical contact portion includes a tubular portion for receiving the insertion member, wherein the first portion of the metal sheet includes a fourth portion corresponding to the mounting wall, and a fifth portion corresponding to the side wall, the second portion of the metal sheet includes a sixth portion corresponding to the tubular portion, wherein the reinforcing interconnection portion of the metal sheet (1) has a strip-like shape, (2) is continuous at one end thereof with the fifth portion, and (3) is continuous at the other end thereof with the sixth portion, and wherein the removing step is performed after the second portion is bent to be formed into the electrical contact portion and before the first portion is bent to be formed into the wire connection portion.

8. The method of claim 6, where in the wire connection portion includes a mounting wall, on which the electric wire can be placed, and a side wall extending upward from the mounting wall, the interconnecting portion (1) has a strip-like shape, (2) is continuous at one end thereof with the side wall, and (3) is continuous at the other end thereof with the electrical contact portion, wherein the first portion of the metal sheet includes a fourth portion corresponding to the mounting wall, and a fifth portion corresponding to the side wall, wherein the reinforcing interconnection portion of the metal sheet interconnects the fourth portion and the third portion, and wherein the removing step is performed after the first portion and the second portion are bent to be formed respectively into the wire connection portion and the electrical contact portion.

* * * * *